US006666718B2

(12) United States Patent
Endo

(10) Patent No.: US 6,666,718 B2
(45) Date of Patent: Dec. 23, 2003

(54) SIDE SPACER STRUCTURE IN CONNECTOR

(75) Inventor: Tomomi Endo, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/262,846

(22) Filed: Oct. 3, 2002

(65) Prior Publication Data

US 2003/0073353 A1 Apr. 17, 2003

(30) Foreign Application Priority Data

Oct. 5, 2001 (JP) ..... P2001-309936

(51) Int. Cl.[7] ..... H01R 13/40
(52) U.S. Cl. ..... 439/595; 439/752
(58) Field of Search ..... 439/595, 752

(56) References Cited

U.S. PATENT DOCUMENTS 5,244,421 A * 9/1993 Jinno et al. ..... 439/752
5,439,397 A * 8/1995 Yamanashi et al. ..... 439/752
5,503,573 A * 4/1996 Sagawa ..... 439/752
5,554,051 A * 9/1996 Shinji et al. ..... 439/595
5,569,055 A * 10/1996 Yamanashi et al. ..... 439/752
5,618,207 A * 4/1997 Maejima ..... 439/595

FOREIGN PATENT DOCUMENTS

JP 4-22079 1/1992

* cited by examiner

*Primary Examiner*—Neil Abrams
*Assistant Examiner*—Phuong K T Dinh
(74) *Attorney, Agent, or Firm*—Sughrue Mion, PLLC

(57) ABSTRACT

A side spacer structure in a connector has a side spacer mounted in a housing body having terminal receiving chambers and including a tentative retention lance for temporarily retaining a terminal inserted into the terminal receiving chambers, a securing portion for securing the terminal in a state for operation, and a terminal releasing lance is provided in a side of the tentative retention lance; wherein a front end of the terminal releasing lance is positioned backward than a front end of the tentative retention lance in an insertion direction of the connector housing.

1 Claim, 7 Drawing Sheets

SIDE SPACER STRUCTURE IN CONNECTOR

The present application is based on Japanese Patent Application No. 2001-309936, which is incorporated herein by reference.

BACKGROUND OF THE INVENTION

1. Field of the Invention

The present invention relates to a side spacer structure in a connector for retaining terminals respectively received into terminal receiving chambers of a connector housing and more particularly to a side spacer structure in a connector, which structure is designed to have members for temporarily retaining terminals and members for releasing the terminals from being retained.

2. Description of the Related Art

In a conventional side spacer structure in a connector, lances for temporarily retaining terminals and slip-off blocking portions for securing terminals are provided in a projecting condition in a manner alternating with each other as shown in FIG. 7 (see Japanese Unexamined Patent Application No. JP-A-04-22079).

In a conventional side spacer structure, temporary retaining lances 4 and slip-off blocking portions 7 are provided alternately with each other to branch plates 3 provided in proximity in a row arrangement to a base portion 2 so as to respectively correspond to a plurality of terminal receiving chambers 12 which will be described later.

The temporary retaining lance 4 has a retaining face 5 coplanar with the top surface 8 of the slip-off blocking portion 7 and when the retaining face 5 is brought into contact with the edge face 15 of a female terminal 14, the female terminal 14 can temporarily be retained (see FIG. 8). Further, the temporary retaining lance 4 has a tapered face 6 tilting forward (upward in FIG. 7) from the retaining face 5.

The slip-off blocking portion 7 has the top surface 8 as a plane substantially perpendicular to the direction in which the terminal is inserted, the top surface 8 being formed in a position where it comes in contact with the edge face 15 of the female terminal 14. When the side spacer 1 is finally secured, the female terminal 14 can finally be retained by making the top surface 8 come in contact with the edge face 15 of the female terminal 14 (see FIG. 9).

A temporary retaining pawl 9 for temporarily retaining the side spacer 1 in a housing body 11 (see FIGS. 8 and 9) is provided at the front end of the base of the branch plate 3 and moreover a final retaining pawl 10 for securing the side spacer 1 in the housing body 11 is provided at both upper and lower ends of the base portion 2.

The temporarily retained condition of the spacer is shown in FIG. 8. When the side spacer 1 is inserted into the housing body 11 and temporarily retained, the temporary retaining lance 4 is disposed so that the retaining face 5 is positioned in the terminal receiving chamber 12. When the female terminal 14 is inserted into the terminal receiving chamber 12 from behind (downward in FIG. 8), the temporary retaining lance 4 is brought into slidable contact with the side of the female terminal 14 and undergoes elastic deformation toward the outer side of the terminal receiving chamber 12. On the arrival of the female terminal 14 in position in the terminal receiving chamber 12, the temporary retaining lance 4 subjected to the elastic deformation is returned to the original position, whereby the retaining face 5 comes to contact the edge face 15 of the female terminal 14. Thus, the female terminal 14 can temporarily be retained in position within the terminal receiving chamber 12.

When the side spacer 1 is thrust into the housing body 11 after the female terminal 14 is temporarily retained, the side spacer 1 is finally secured in the housing body 11. When the side spacer 1 is finally secured as shown in FIG. 9, the temporary retaining lance 4 (see FIG. 8) is released from the edge face 15 of the female terminal 14 whereby to make the top surface 8 of the slip-off blocking portion 7 retain the edge face 15 instead. As the slip-off blocking portion 7 is never released from the edge face 15 because of the elastic deformation, the female terminal 14 is finally secured in position within the terminal receiving chamber 12.

When the female terminal 14 is pulled out of the housing body 11, the side spacer 1 is returned to the temporary retaining condition as shown in FIG. 8. Further, a jig (not shown) is inserted into a terminal releasing hole 13 and brought into contact with the tapered face 6 of the temporary retaining lance 4 whereby to make the temporary retaining lance 4 undergo the elastic deformation toward the outer side of the terminal receiving chamber 12. In other words, the retaining face 5 and the edge face 15 are released from being retained together, so that the female terminal 14 is allowed to move backward.

However, as the size of the housing body decreases in size, the temporary retaining lance is also made smaller and thinner. In other words, the allowable stress of the temporary retaining lance against elastic deformation lowers. In case where the jig is used to displace the temporary retaining lance when the terminal is released from being retained, the problem is that there may occur elastic deformation or damage caused to the temporary retaining lance.

SUMMARY OF THE INVENTION

An object of the invention intended to solve the foregoing problems is to provide a side spacer structure in a connector so devised as to prevent the deformation of and damage to temporary retaining lances when terminals are released from being retained.

In order to accomplish the object above, there is provided a side spacer structure in a connector comprising:

- a connector housing having at least one of terminal receiving chambers in each of which a terminal is accommodated;
- a side spacer mounted from a side face of the connector housing, the side spacer including
  - an outer member having a U-shape, and
  - a branch plate projecting from the outer member in a direction in which the side spacer is inserted to the connector housing,
  - the branch plate including a tentative retention lance for temporarily retaining the terminal inserted into the terminal receiving chambers from a fitting side of the connector housing,
  - a securing portion for securing the terminal in a state for operation, and
  - a terminal releasing lance provided in a side portion of the tentative retention lance;
- wherein a front end of the terminal releasing lance is positioned backward than a front end of the tentative retention lance in a fitting direction of the connector housing.

In the side spacer structure in the connector thus arranged, the terminal releasing lance is provided in the side portion of the tentative retention lance in a connected row arrangement, so that it is only needed to make the terminal releasing lance undergo elastic deformation when the terminal is released from being retained. At this time, since a front end of the terminal releasing lance is positioned backward than a front end of the tentative retention lance, the terminal releasing lance in the direction of inserting the terminal is set shorter in length than the lance for temporarily retaining the terminal.

Therefore, the displacement amount required to make the terminal releasing lance undergo the elastic deformation can be made smaller than the displacement amount required to directly make the lance for temporarily retaining the terminal undergo the elastic deformation, which results in decreasing the load applied to the lance for temporarily retaining the terminal. Thus, the lance for temporarily retaining the terminal is prevented from undergoing plastic deformation as well as being damaged when the terminal is released from being retained.

DETAILED DESCRIPTION OF THE PREFERRED EMBODIMENTS

Figure 1:
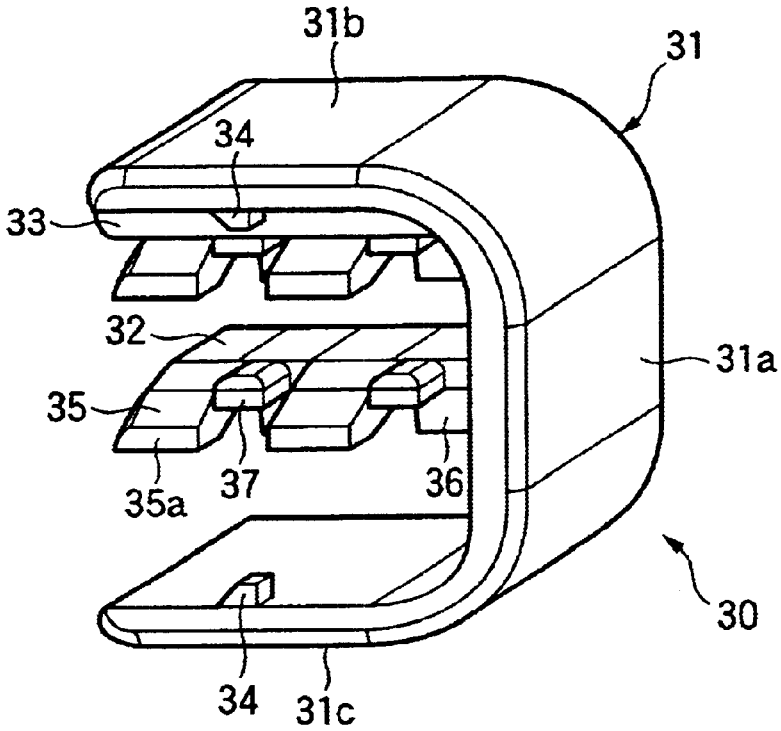
FIG. 1 is a perspective view of a side spacer structure in a connector embodying the invention.
Figure 2:
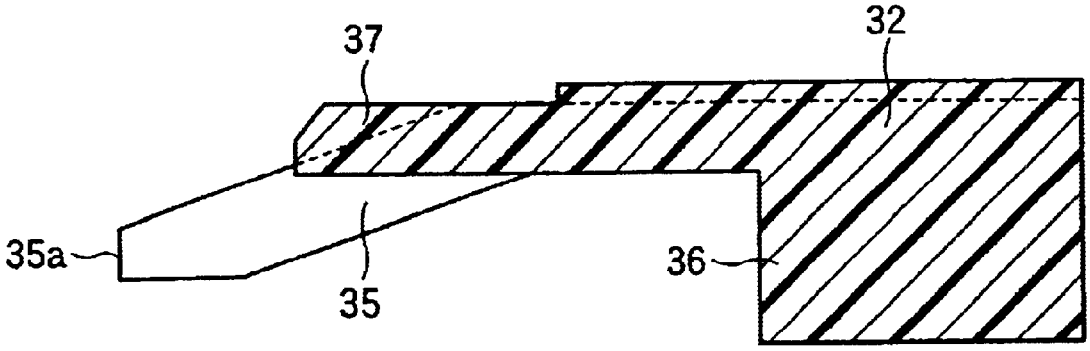
FIG. 2 is a vertical sectional view showing the lengthwise profile of a terminal releasing lance in FIG. 1.
Figure 3:
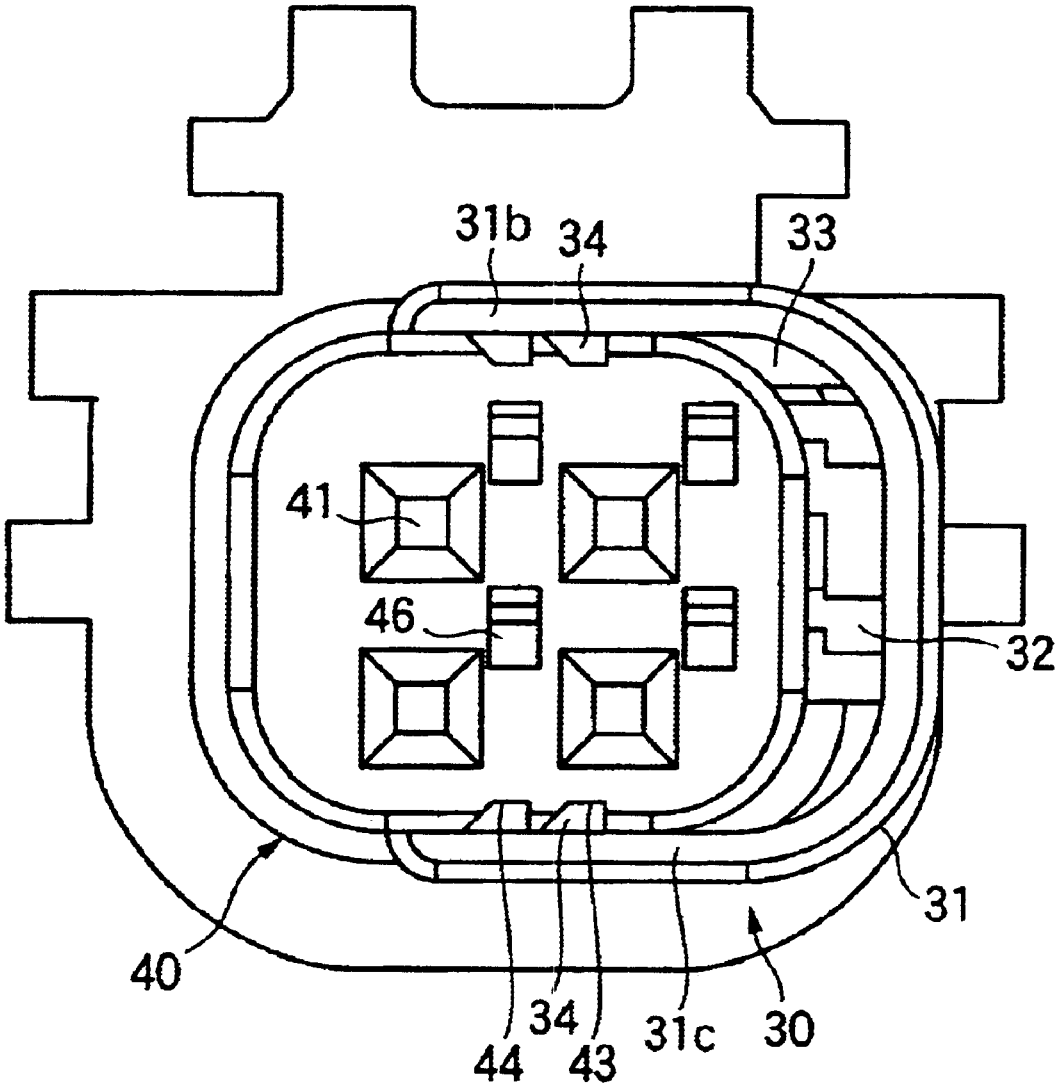
FIG. 3 is a plan view of a side spacer temporarily retained in a connector housing as seen from the front in FIG. 1.
Figure 4:
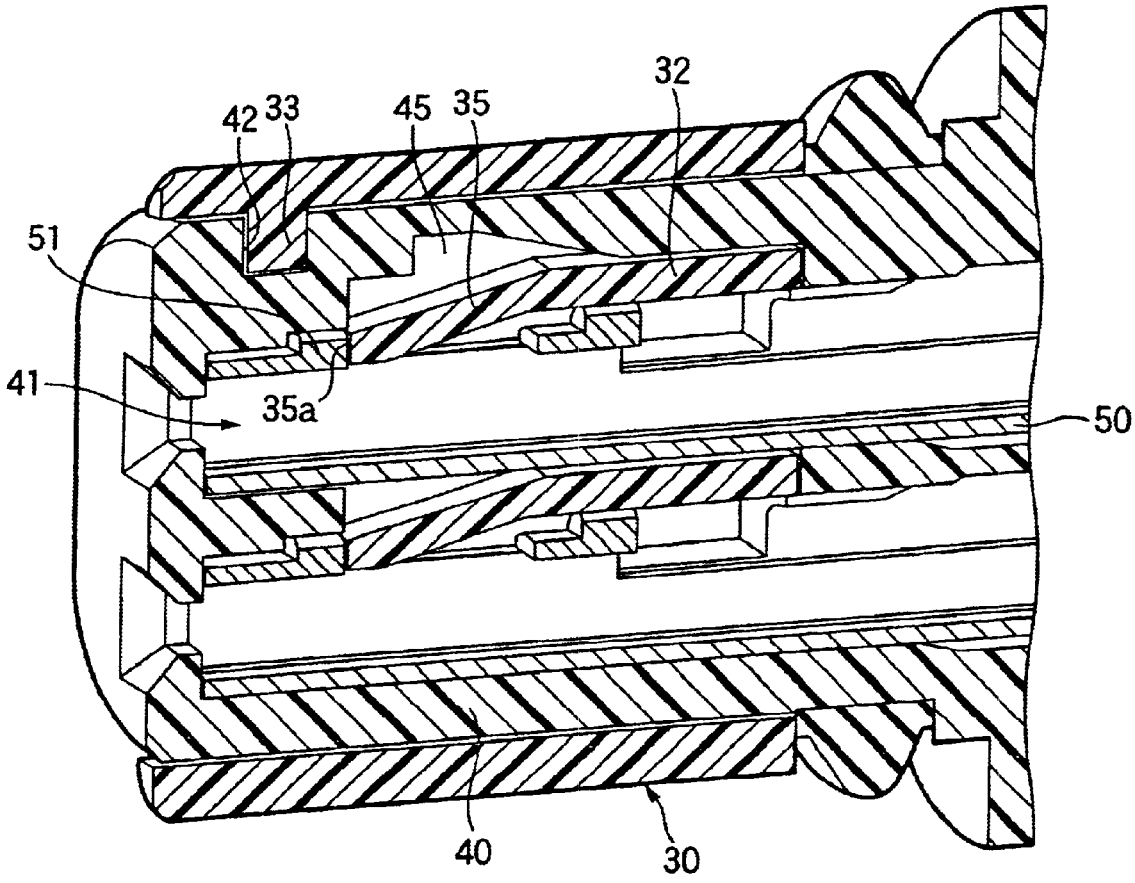
FIG. 4 is a vertical sectional view of a terminal received into a terminal receiving chamber in FIG. 3.
Figure 5:
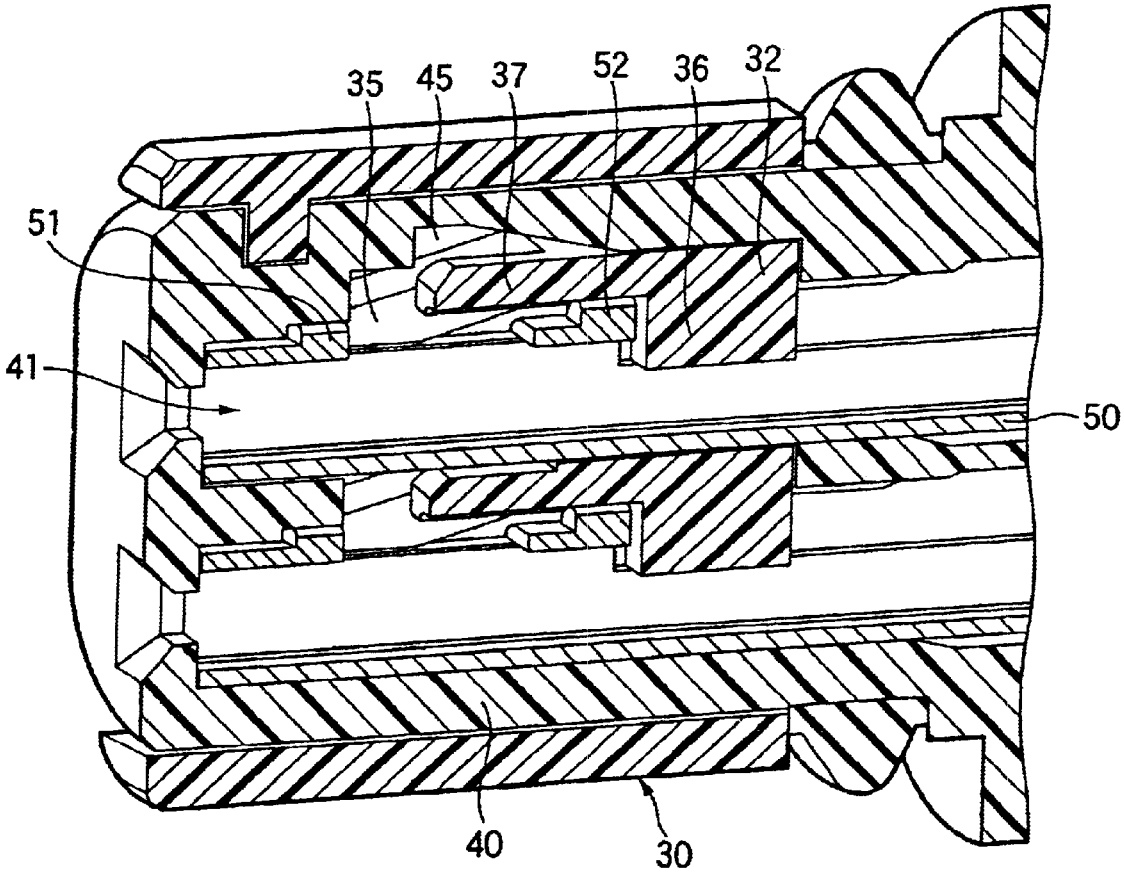
FIG. 5 is a vertical sectional view of the side spacer of FIG. 4 finally secured inside.

A description will now be given of a side spacer structure in a connector embodying the invention with reference to FIGS. 1 to 6. FIG. 1 is a perspective view of a side spacer structure in a connector embodying the invention; FIG. 2, a vertical sectional view showing the lengthwise profile of a terminal releasing lance in FIG. 1; FIG. 3, a plan view of a side spacer temporarily retained in a connector housing as seen from the front in FIG. 1; FIG. 4, a vertical sectional view of a terminal received into a terminal receiving chamber in FIG. 3; FIG. 5, a vertical sectional view of the side spacer of FIG. 4 finally secured inside; and FIG. 6, a vertical sectional view of the terminal when it is released from being retained.

As shown in FIG. 1, according to this embodiment of the invention, a side spacer 30 made of synthetic resin material comprises an outer member 31 to be mated with a housing body 40 when the outer member 31 is attached thereto which will be described later and branch plates 32 inserted into a plurality of terminal receiving chambers 41 from the side portions of the housing body 40, the branch plate 32 being projected from a side plate 31*a* to a position surrounded with the outer member 31.

The outer member 31 is a plate-like member curved in U-shape and formed so that it is covered with a side plate 31*a*, an upper plate 31*b* and a lower plate 31*c* when attached to the housing body 40.

The branch plates 32 are projected sideways from the inside of the side plate 31*a* and respectively passed through the plurality of terminal receiving chambers 41 when attached to the housing body 40, so that a female terminal 50 can be retained inside as described later.

A guide rib 33 extending in the direction in which the side spacer 30 is attached to the housing body 40 is provided beneath the underside of the upper plate 31*b* and mates with the guide groove 42 of the housing body 40 as described later. Further, a retaining projection 34 is provided on the underside of the upper plate 31*b* and the top surface of the lower plate 31*c* both. When the retaining projections 34 are temporarily retained inside the housing body 40, the retaining projections 34 are retained in the respective temporary retaining holes 43 of the housing body 40 and when the retaining projections 34 are finally secured inside the housing body 40, the retaining projections 34 are retained in the respective final retaining holes 44 of the housing body 40 (see FIG. 3).

The branch plate 32 is projected in two parallel places of the inside of the side plate 31*a* in conformity with the position of the terminal receiving chamber 41 of the housing body 40. As shown in FIGS. 1 and 2, a tentative retention lances 35 for temporarily retaining the terminals are extended forward and a plurality of securing portions 36 for securing the terminals are formed in such a manner as to correspond to the plurality of terminal receiving chambers 41. Moreover, terminal releasing lances 37 are provided in the respective side portions of the tentative retention lances 35 in a connected row arrangement.

The tentative retention lance 35 is extended forward further than the branch plate 32 with its front end tilted downward and can be subjected to elastic displacement vertically. The front 35*a* of the front end portion is a plane perpendicular to the direction into which the female terminal 50 is inserted and works to temporarily retain the female terminal 50 by coming in contact with the rear end of a temporary retaining projection 51.

The securing portion 36 for securing the terminal is provided under and integrally with the branch plate 32 and the front end of the securing portion 36 for securing the terminal forms a plane perpendicular to the direction into which the female terminal 50 is inserted. As the securing portion 36 for securing the terminal is in the form of a rectangular parallelepiped and highly rigid and used to finally secure the female terminal 50 by coming in contact with the rear end of a final retaining projection 52.

The terminal releasing lance 37 is extended forward from the branch plate 32 and formed in the way linked with the side portion of the tentative retention lance 35. Moreover, the front end of the terminal releasing lance 37 is set further back from the front end of the tentative retention lance 35. Consequently, the terminal releasing lance 37 in the direction of inserting the terminal is set shorter in length than the tentative retention lance 35.

Figure 6:
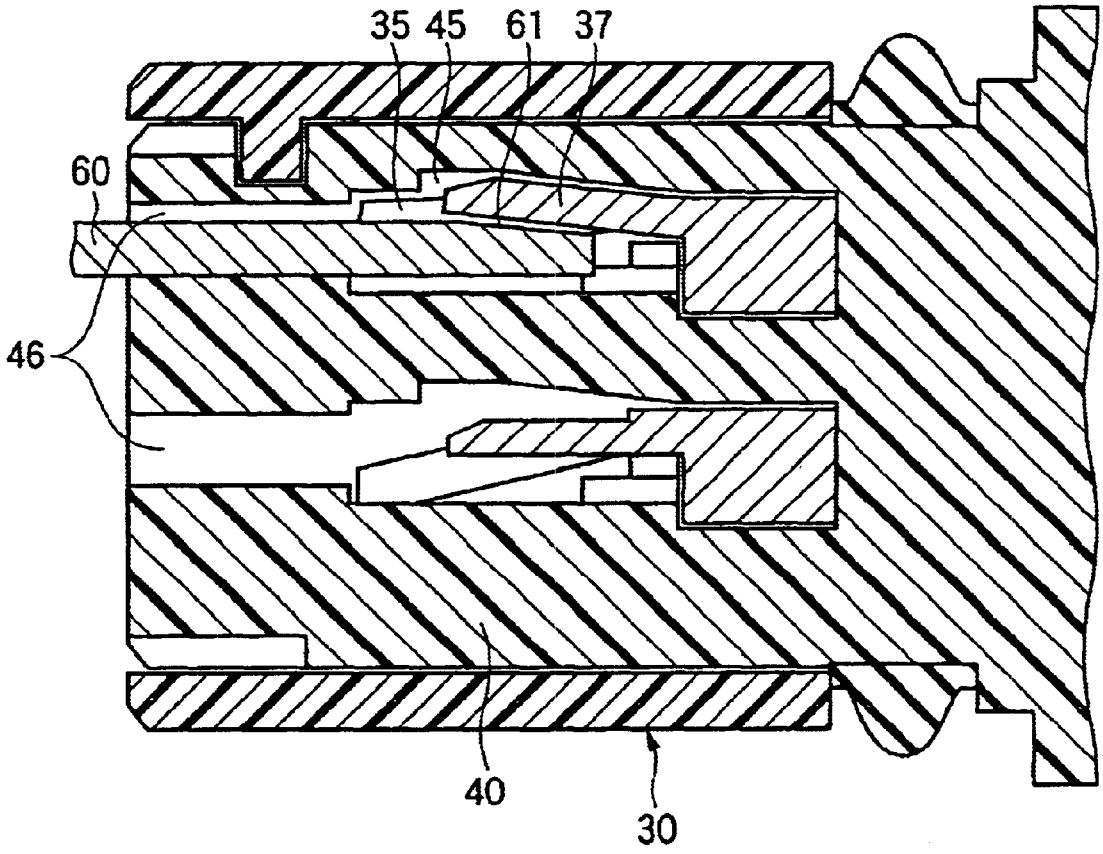
FIG. 6 is a vertical sectional view of the terminal when it is released from being retained.
Figure 7:
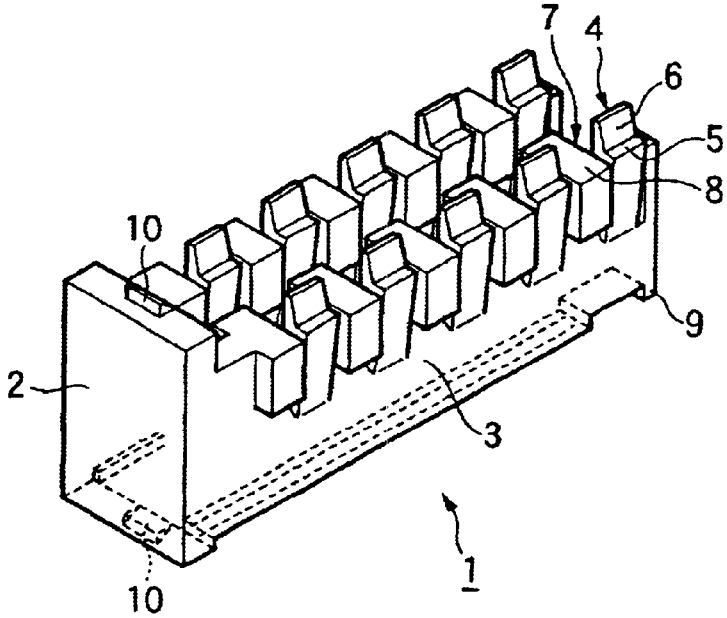
FIG.7 PRIOR ART
FIG. 7 is a perspective view of a conventional side spacer structure in a connector.
Figure 8:
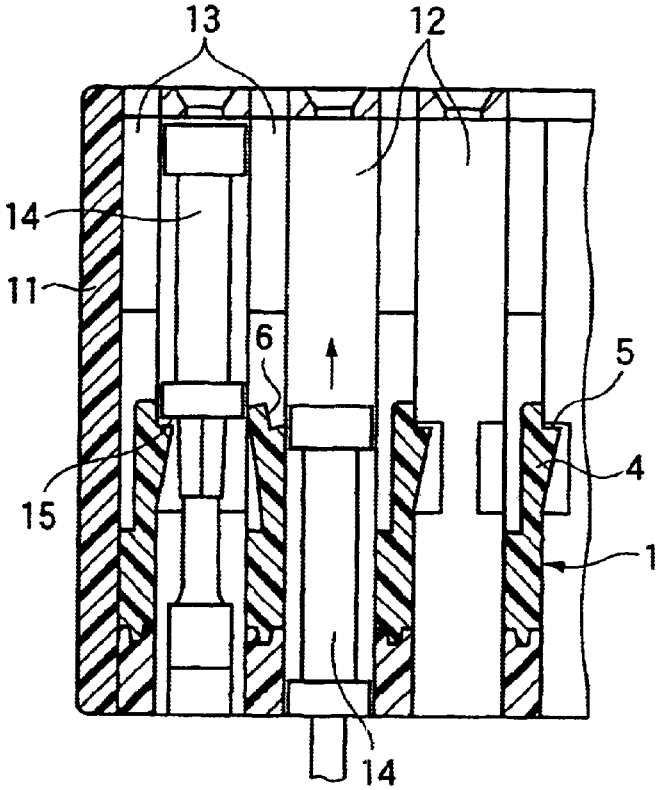
FIG.8 PRIOR ART
FIG. 8 is a vertical sectional view of a side spacer of FIG. 7 temporarily retained.
Figure 9:
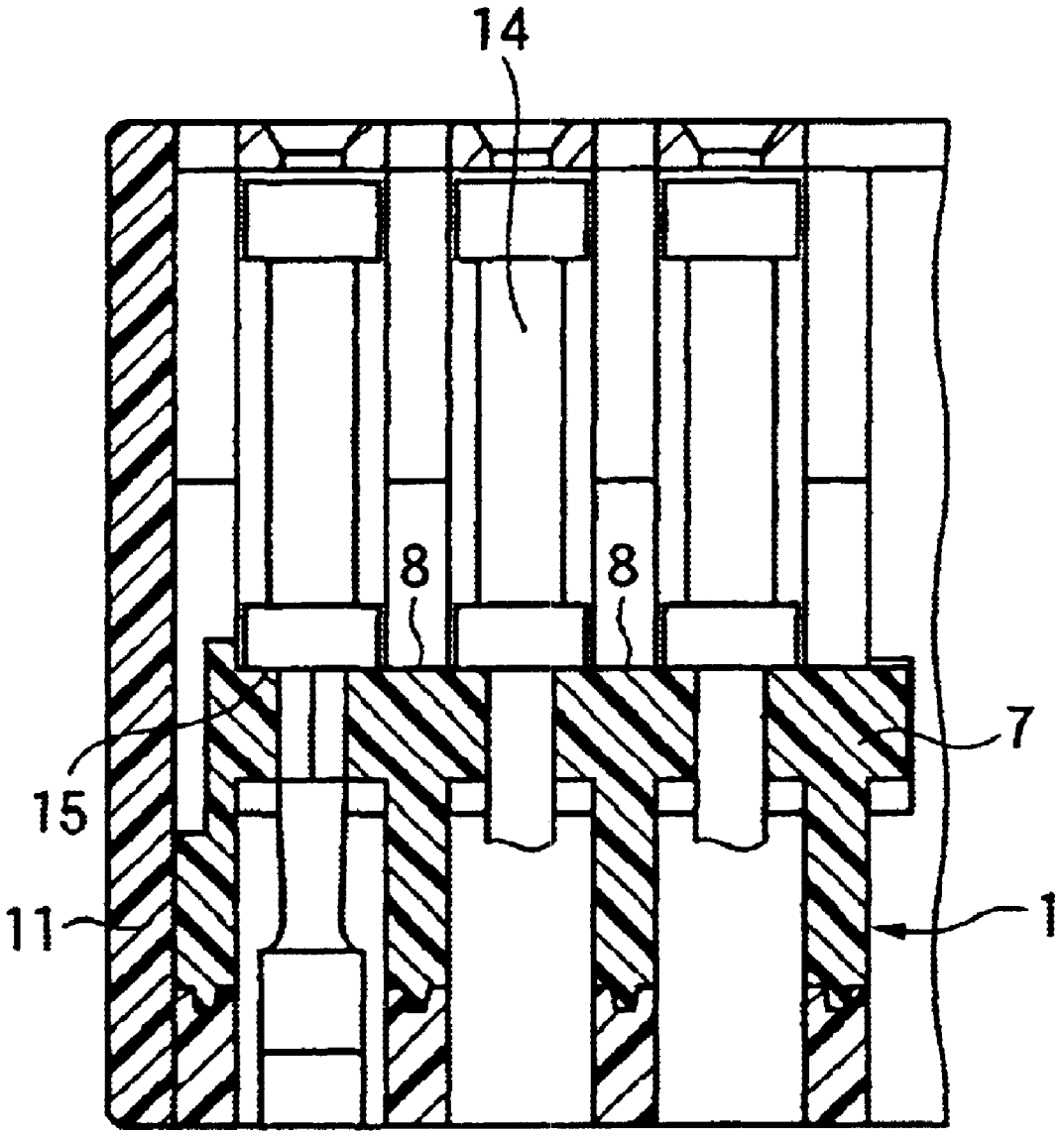
FIG.9 PRIOR ART
FIG. 9 is a vertical sectional view of the side spacer of FIG. 7 finally secured.

When the operation of releasing the female terminal 50 is performed, the terminal releasing lance 37 is subjected to upward elastic displacement by a releasing jig 60 (see FIG. 6). Thus, the tentative retention lance 35 also undergoes the upward elastic displacement with the elastic displacement of the terminal releasing lance 37 so as to release the female terminal 50 from being retained. Therefore, a space is provided under the terminal releasing lance 37 so that the releasing jig 60 is insertable.

As shown in FIG. 3, the guide rib 33 is mated with the guide groove 42 (see FIG. 4) when the side spacer 30 is attached to the housing body 40 and the branch plate 32 is laterally inserted into the through-hole 45 passing through the plurality of terminal receiving chambers 41 from one side portion of the housing body 40. When the pair of retaining projections 34 provided in a manner opposite to the upper plate 31*b* and the lower plate 31*c* of the outer member 31 are mated with the respective temporary retaining holes 43 formed in the upper and lower portions of the housing body 40, the side spacer 30 is temporarily retained.

When the side spacer 30 is thrust in, further, the engagement of the retaining projections 34 with the temporary retaining holes 43 are released and the retaining projections 34 are mated with the respective final retaining holes 44 formed in the upper and lower portions of the housing body 40, so that the side spacer 40 is finally secured.

As shown in FIG. 4, while the side spacer 30 is temporarily retained, the female terminal 50 is inserted into the terminal receiving chamber 41 from behind. Then the top surface of the female terminal 50 is brought into slidable contact with the tentative retention lance 35 and when the female terminal 50 is received in position in the terminal receiving chamber 41 with the tentative retention lance 35 being bent upward, the front 35*a* of the tentative retention lance 35 comes in contact with the rear end of the temporary retaining projection 51 provided above the forward portion of the female terminal 50 so as to have the female terminal 50 temporarily retained.

As shown in FIG. 5, the branch plate 32 is slidably moved deep in the through-hole 45 and the tentative retention lance 35 is released from the temporary retaining projection 51 when the side spacer 30 is finally secured and the front end of the securing portion 36 for securing the terminal comes in contact with the rear end of the final retaining projection 52 of the female terminal 50. As the securing portion 36 for securing the terminal is prevented from being released from the final retaining projection 52 because of the elastic deformation, the female terminal 50 is finally secured in position in the terminal receiving chamber 41.

When the female terminal 50 is pulled out of the housing body 40, the side spacer 30 is returned to the temporary retaining position first as shown in FIGS. 3 and 4. As shown in FIG. 6, further, the jig 60 having a tapered face 61 in the upper portion at its front end is inserted from the front of the terminal releasing hole 46 and brought into slidable contact with the underside of the terminal releasing lance 37 whereby to make the terminal releasing lance 37 undergo the upward elastic deformation toward the through-hole 45. More specifically, the tentative retention lance 35 connected to the terminal releasing lance 37 in a connective arrangement is also displaced upward and the tentative retention lance 35 and the temporary retaining projection 51 are released from being retained together, so that the female terminal 50 is allowed to move backward.

In this case, the front end of the terminal releasing lance 37 is positioned backward further than the front end of the tentative retention lance 35, that is, the terminal releasing lance 37 in the direction of inserting the terminal is set shorter in length than the tentative retention lance 35.

Therefore, the displacement amount of the terminal releasing lance 37 required for the tentative retention lance 35 and the temporary retaining projection 51 to be released from being retained together is reducible, which results in decreasing the load applied to the tentative retention lance 35. Thus, the tentative retention lance 35 is prevented from undergoing plastic deformation as well as being damaged.

As set forth above, in the side spacer structure in the connector thus arranged, the terminal releasing lances are provided in the respective side portions of the tentative retention lances in a connected row arrangement, so that it is only needed to make the terminal releasing lance undergo the elastic deformation when the terminal is released from being retained. At this time, since the front end of the terminal releasing lance is positioned backward further than the front end of a tentative retention lance for temporarily retaining the terminal, the terminal releasing lance in the direction of inserting the terminal is set shorter in length than the tentative retention lance.

Therefore, the displacement amount required to make the terminal releasing lance undergo the elastic deformation can be made smaller than the displacement amount required to directly make the tentative retention lance undergo the elastic deformation, which results in decreasing the load applied to the tentative retention lance. Thus, the tentative retention lance is prevented from undergoing plastic deformation as well as being damaged when the terminal is released from being retained.

What is claimed is:

1. A side spacer structure in a connector comprising:

a connector housing having at least one of terminal receiving chambers in each of which a terminal is accommodated;

a side spacer mounted from a side face of said connector housing, said side spacer including an outer member having a U-shape, and a branch plate projecting from said outer member in a direction in which said side spacer is inserted to said connector housing, said branch plate including a tentative retention lance for temporarily retaining the terminal inserted into said terminal receiving chambers from a fitting side of the connector housing, a securing portion for securing the terminal in a state for operation, and a terminal releasing lance provided in a side portion of the tentative retention lance;

wherein a front end of the terminal releasing lance is positioned backward than a front end of the tentative retention lance in a fitting direction of the connector housing.

* * * * *